US008087968B2

(12) United States Patent
Amron

(10) Patent No.: US 8,087,968 B2
(45) Date of Patent: Jan. 3, 2012

(54) DEVICE FOR DISCHARGING A STREAM OF FLUID IN A PATTERN AND METHOD OF USING SAME

(75) Inventor: Alan Amron, Brooklyn, NY (US)

(73) Assignee: Thought Development, Inc., Miami Beach, FL (US)

( * ) Notice: Subject to any disclaimer, the term of this patent is extended or adjusted under 35 U.S.C. 154(b) by 150 days.

(21) Appl. No.: 11/523,353

(22) Filed: Sep. 19, 2006

(65) Prior Publication Data

US 2007/0045446 A1 Mar. 1, 2007

Related U.S. Application Data

(63) Continuation-in-part of application No. 11/271,613, filed on Nov. 12, 2005, now Pat. No. 7,837,067, which is a continuation-in-part of application No. 11/136,693, filed on May 23, 2005, now Pat. No. 7,458,485, application No. 11/523,353, which is a continuation-in-part of application No. 11/237,424, filed on Sep. 28, 2005, now Pat. No. 7,731,103, which is a continuation-in-part of application No. 11/230,143, filed on Sep. 19, 2005, now Pat. No. 7,374,069.

(51) Int. Cl.
*A63H 33/28* (2006.01)

(52) U.S. Cl. ..... 446/15; 239/237

(58) Field of Classification Search ..... 446/15; 239/237, 525

See application file for complete search history.

(56) References Cited

U.S. PATENT DOCUMENTS

| | | | | |
|---|---|---|---|---|
| 1,150,940 | A | 8/1915 | Irish | |
| 1,798,488 | A | 3/1931 | Orr | |
| 1,941,786 | A | 1/1934 | Carley et al. | |
| 2,381,740 | A | 8/1945 | Grelson | |
| 2,552,716 | A | 5/1951 | Holland | |
| 2,564,639 | A | 8/1951 | Cuppett et al. | |
| 2,794,292 | A * | 6/1957 | Noble | 446/16 |
| 2,830,739 | A | 4/1958 | Moye | |
| 2,998,166 | A | 8/1961 | Klawiter | |
| 3,160,348 | A | 12/1964 | Hunter | |
| 3,399,638 | A | 9/1968 | Bishop et al. | |
| 3,493,179 | A | 2/1970 | Lee | |
| 3,508,709 | A | 4/1970 | Serbousek et al. | |
| 3,556,689 | A | 1/1971 | Heckler, Iv | |
| 3,628,700 | A | 12/1971 | Dodoghue | |
| 3,804,336 | A | 4/1974 | Koeppe | |
| 4,286,736 | A | 9/1981 | Corsette | |
| 4,335,677 | A | 6/1982 | Nagata | |
| 4,397,879 | A | 8/1983 | Wilson | |
| 4,501,391 | A | 2/1985 | Hunter | |
| 4,542,853 | A | 9/1985 | Diamond | |
| 4,615,488 | A | 10/1986 | Sands | |
| 4,709,691 | A | 12/1987 | Lemons | |
| 4,744,517 | A | 5/1988 | Iwamoto | |
| 4,821,961 | A | 4/1989 | Shook | |

(Continued)

*Primary Examiner* — Gene Kim
*Assistant Examiner* — Michael Dennis
(74) *Attorney, Agent, or Firm* — Cohen Pontani Lieberman & Pavane

(57) ABSTRACT

A nozzle discharge assembly includes a housing having a connection for receiving a pressurized supply of liquid and a nozzle having a discharge orifice movable relative to the housing. A mechanism controls a movement of the discharge orifice so that the discharge orifice moves in a pattern relative to the housing for creating a substantially helical stream of liquid when the pressurized supply of liquid flows through the discharge orifice.

18 Claims, 13 Drawing Sheets

U.S. PATENT DOCUMENTS 4,838,490 A 6/1989 Nissels
4,842,200 A 6/1989 Hermansson
4,860,954 A 8/1989 Allemann
4,989,786 A 2/1991 Kranzle et al.
5,024,382 A 6/1991 Shook
5,052,622 A 10/1991 Lindermeir et al.
5,060,863 A 10/1991 Hammelmann
5,086,974 A 2/1992 Henshaw
5,104,043 A 4/1992 Pacht
5,119,971 A 6/1992 Reyman
5,127,553 A 7/1992 Weinstein
5,224,652 A 7/1993 Kessler
5,244,153 A 9/1993 Kuhn et al.
5,297,979 A 3/1994 Amron
5,350,115 A 9/1994 Burnworth et al.
5,392,968 A 2/1995 Dark
5,395,053 A 3/1995 Frech
5,417,370 A 5/1995 Kah
5,427,320 A 6/1995 Mak et al.
5,433,646 A 7/1995 Tarng
5,456,413 A 10/1995 Ellis
5,492,275 A 2/1996 Crampton
5,505,380 A 4/1996 Jun
5,582,532 A 12/1996 Tucker
5,586,688 A 12/1996 Johnson et al.
5,595,345 A 1/1997 Chura et al.
5,667,138 A 9/1997 Crampton
5,674,323 A 10/1997 Garcia
5,725,680 A 3/1998 Mathieus
5,740,964 A 4/1998 Crampton
5,826,750 A 10/1998 Johnson
5,833,124 A 11/1998 Groves
5,865,344 A 2/1999 Nagel
5,878,914 A 3/1999 Johnson
6,007,003 A 12/1999 Wang
6,129,293 A 10/2000 Jager
6,138,871 A 10/2000 D'Andrade
6,151,824 A 11/2000 Clayton
6,152,651 A 11/2000 Glidewell et al.
6,155,494 A 12/2000 Fabbri
6,186,367 B1 2/2001 Harrold
6,196,475 B1 3/2001 Jaeger
6,199,771 B1 3/2001 Clearman et al.
6,217,245 B1 4/2001 El-Fakir et al.
6,247,658 B1 6/2001 Bakas
6,250,506 B1 6/2001 Geiger et al.
6,330,960 B1 12/2001 Faughey et al.
6,331,130 B1 12/2001 Thai
6,364,162 B1 4/2002 Johnson et al.
6,408,967 B1 * 6/2002 Huntsberger et al. ..... 180/65.1
6,422,480 B1 7/2002 Richmond
6,474,507 B1 11/2002 Hornsby
RE38,077 E 4/2003 Cohen
6,540,108 B1 4/2003 Johnson
6,594,843 B1 7/2003 Wilkins
6,648,244 B2 11/2003 Yu
6,676,037 B2 1/2004 Marks
6,719,218 B2 4/2004 Cool et al.
6,766,967 B2 7/2004 Harris
6,769,631 B2 8/2004 Brown
6,892,902 B2 5/2005 Hornsby et al.
6,899,286 B2 5/2005 Blessing
6,905,388 B2 6/2005 Schoonmaker
6,935,531 B1 8/2005 Clayton
6,959,838 B2 11/2005 Eddins et al.
7,032,837 B2 4/2006 Eddins et al.
7,097,073 B2 8/2006 Zimmerman
7,111,795 B2 9/2006 Thong
7,131,557 B2 11/2006 Zimmerman et al.
7,175,107 B2 2/2007 Amaduzzi
7,182,477 B1 2/2007 Hartz
7,185,787 B2 3/2007 Brown et al.
7,374,069 B2 5/2008 Amron
7,549,599 B2 6/2009 Amron
2001/0019083 A1 9/2001 Marks
2002/0030066 A1 3/2002 McKenna
2002/0090878 A1 * 7/2002 Holmes ..... 446/15
2003/0071141 A1 4/2003 Rieben
2003/0085303 A1 5/2003 Jaeger
2004/0142626 A1 * 7/2004 Choi ..... 446/15
2004/0164090 A1 8/2004 Eddins et al.
2005/0035148 A1 2/2005 Zimmerman
2005/0127203 A1 6/2005 DeWitt
2005/0145724 A1 * 7/2005 Blette et al. ..... 239/525
2005/0173559 A1 * 8/2005 Eddins et al. ..... 239/302
2006/0065760 A1 * 3/2006 Micheli ..... 239/237
2006/0076435 A1 4/2006 Hudson
2006/0261087 A1 11/2006 Amron
2006/0261184 A1 11/2006 Amron

* cited by examiner

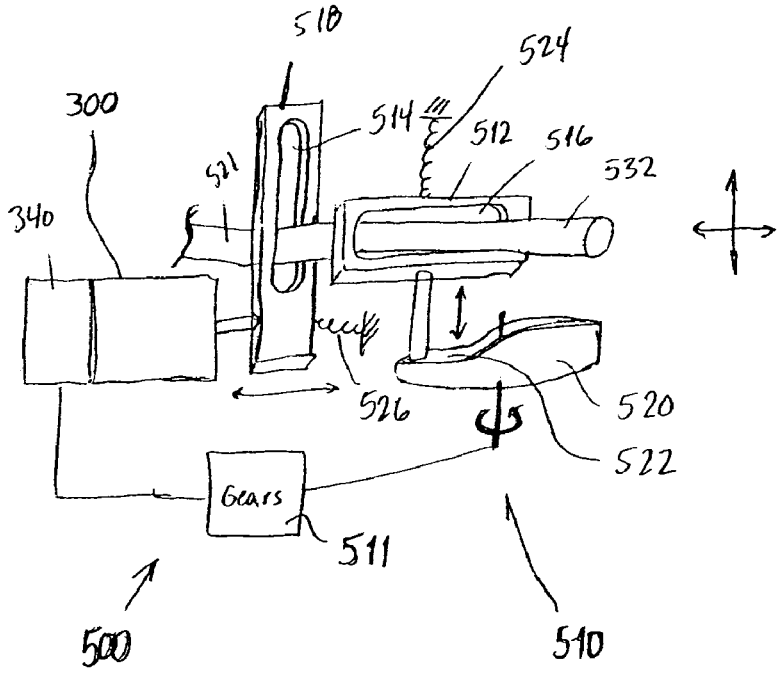
Fig. 11A
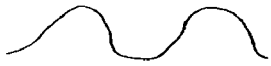
Fig. 12c
Fig. 12b
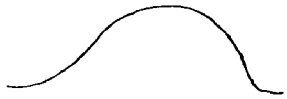
Fig. 12a

DEVICE FOR DISCHARGING A STREAM OF FLUID IN A PATTERN AND METHOD OF USING SAME

REFERENCE TO RELATED APPLICATIONS

This application is a continuation-in-part of U.S. patent application Ser. No. 11/271,613, filed on Nov. 12, 2005 now U.S. Pat. No. 7,837,067, which is a continuation-in-part of U.S. patent application Ser. No. 11/136,693, filed on May 23, 2005 now U.S. Pat. No. 7,458,485.

This application is also a continuation-in-part of U.S. patent application Ser. No. 11/237,424, filed on Sep. 28, 2005 now U.S. Pat. No. 7,731,103, which is a continuation-in-part of U.S. patent application Ser. No. 11/230,143, filed on Sep. 19, 2005 now U.S. Pat. No. 7,374,069.

BACKGROUND OF THE INVENTION

The present invention relates generally to devices for discharging a stream of water or other fluid in a pattern.

There are many different devices which create streams of water or other fluids such as, by way of non-limiting examples, toy water guns, garden hose nozzles, lawn sprinklers, water fountain displays, food dispensing containers, cleaning product dispensing containers, and paint dispensing containers. The use of a continuous straight stream, while adequate in most cases, may fail to provide adequate coverage of a target area or may simply be too plain.

United States Patent Application Publication No. US 2005/0173559 discloses a water gun with a variable spray pattern. According to this application, a manual pump is actuated to provide both the pressure to emit a stream of water through a nozzle and to rotate the nozzle about an axis of rotation. The nozzle is offset from the axis of rotation so that actuation of the manual pump creates a patterned stream. Furthermore, this application discloses a bezel-type adjustment for adjusting a radial position of the nozzle relative to the axis of rotation. A problem associated with this device is that the rotation of the nozzles for creating the variable spray is directly linked to the movement of the manual pump, making it difficult for a user to operate the pump.

Squeeze bottles for storing and dispensing viscous, flowable materials such as food products like syrups, jellies, and condiments, liquid paints used to produce "spin art", and other liquid and/or granular materials such as detergents, cleansers and the like are well known. Generally, such bottles include a container made of a plastic or other easily deformable material and define an interior cavity for receiving and storing the product. The container may further define a neck portion disposed at one end of the container that is attached to a dispensing closure assembly. A typical dispensing closure assembly includes a cap that is threadably connected to the neck of the container at one end, and has a single outlet tip that faces outwardly from the container at the other end. During use, the container is inverted and squeezed to dispense the viscous product from the tip orifice onto a target surface as a directed stream.

Conventional dispensing closures define an orifice having a circular cross section sized to provide the user with flexibility to apply a desired amount of product to the target surface. A softer squeezing of the container will yield a lower mass flow rate out of the tip. Accordingly, in order to accommodate those who wish to apply only a small amount of material to the target surface, the tips are generally designed with a small cross section. Those who desire an additional amount of material can squeeze harder. In the context of a child's spin art toy environment, the target surface consists of a sheet of paper or other material temporarily secured to a turntable adapted to rotate at a controlled rate. As the sheet rotates, the child squeezes the container and the expelled material moves outwardly through the exertion of centrifugal forces. Although the spin art amusement device continues to enjoy a degree of popularity after several decades, its reliance upon a powered rotary mechanism comes at a considerable cost and complexity.

A need therefore exists for a discharge assistant usable in combination with a conventional container that enables one to apply a sufficient and consistent amount of a flowable material, such as a spin art paint solution, to a target surface.

A further need exists for a spin art amusement system that avoids the cost and complexity of prior art systems.

Water nozzles are used in water fountain displays to produce a stream of water. Such fountains have been in use for centuries and incorporated into landscape designs for parks and residences. A need exists for a different stream so that the water fountains are more entertaining.

SUMMARY OF THE INVENTION

An object of the present invention is to provide a nozzle translation assembly for moving a discharge orifice of a nozzle so that a helical stream or zig-zag stream of fluid exits the nozzle.

Another object of the present invention is to provide a nozzle translation assembly for selectively moving a discharge orifice of a nozzle in one of a plurality of patterns to produce various shaped streams of fluid exiting the nozzle.

Translation of the discharge orifice to form a helical flow path can be achieved in a variety of ways. For example, the nozzle translation assembly may include a rotatable section for rotating the discharge orifice about an axis of rotation. A water- or electrically powered mechanism may be arranged for moving the discharge orifice along a predefined path. By way of illustration, the discharge orifice may be defined as part of a tube connected via a bearing to a housing so that the tube and orifice nozzle rotate about the axis of rotation via the bearing.

Translation of the discharge orifice to form a zig-zag flow path may be achieved in a variety of ways. A water- or electrically powered mechanism including a cam disk may be actuated for rotating the cam disk about an axis of rotation for imparting a reciprocal motion to the discharge orifice.

According to a further embodiment, the discharge orifice is connected to a first mechanism for moving the discharge orifice in a first direction and a second mechanism for moving the discharge orifice in a second direction. The first and second mechanisms move simultaneously for creating a motion which results in the production of a helical stream. At least one of the first and second mechanism may include parts defining a plurality of patterns and a selecting device for selecting one of the plural patterns.

According to yet another embodiment, a plurality of nozzle translation devices are mounted on a mechanism which is movable for selectively connecting the nozzle translation assemblies to a conduit or other source of flowable liquid. In this embodiment, the mechanism can be switched between various nozzle translation assemblies to produce different patterns.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The details of the present invention, both as to its construction and operation can best be understood with reference to the accompanying drawings, in which like numerals refer to like parts, and in which:

FIG. 11 is a schematic diagram of a nozzle translation assembly according to another embodiment of the present invention;

FIGS. 12A-12C depict various cam shapes to be used in the embodiment of FIG. 11;

DETAILED DESCRIPTION OF THE INVENTION

Figure 1:
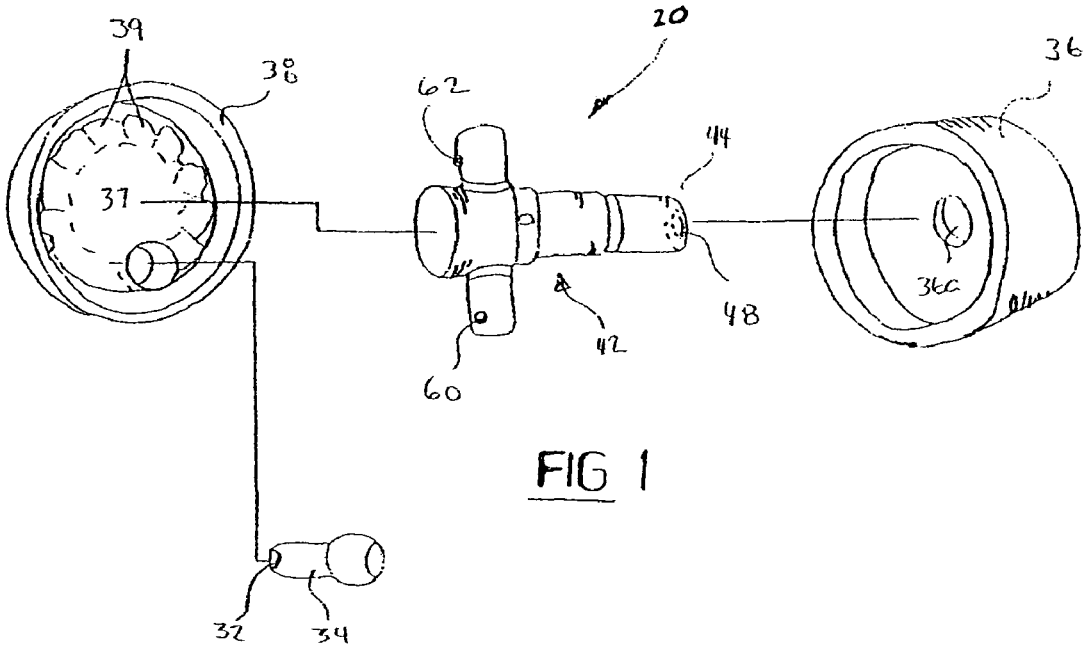
FIG. 1 is broken apart, perspective view depicting the internal construction of an exemplary nozzle translation assembly according to an embodiment of the present invention.

Embodiments of nozzle translation assemblies are described below and depicted in various applications such as on water guns, food dispensing containers, cleaning agent dispensing containers, garden hose nozzles, lawn sprinklers and water fountain nozzles. Other contemplated applications include mounting the nozzle translation assemblies on windshield wiper sprayers for automobiles, bath faucets, and containers which are squeezed to dispense the flowable product within such as spin art paint containers and condiment containers. Accordingly, the nozzle translation assembly has a wide range of applications covering many different fields or disciplines. The particular applications described are therefore examples only and are not meant to restrict the scope of the claimed invention in any way.

With regard to fastening, mounting, attaching or connecting components of the present invention to form the fluid discharge device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

With regard to the manner in which water is urged to flow toward a discharge orifice upon depression of a trigger or other means, it should be borne in mind that although the various embodiments described herein incorporate an on-board pump for pressurizing a water-containing, fixed-volume chamber with air, the invention is not limited to such configurations. For example, if the delivery of intermittent pulses are desired, a motorized arrangement as, for example, one described in U.S. Pat. No. 4,022,350, issued to the inventor herein, Alan Amron, may be used. By way of further example, the water storing chamber may be configured as an expandable bladder dimensioned and arranged to receive and store water from a hose end adapter coupled to a municipally pressurized water source (as in the case of the aforementioned U.S. Pat. Nos. 4,854,480 and 4,735,239 to Shindo and Salmon et al, respectively). By way of still further example, a device constructed in accordance with the teachings of the present invention may utilize both a bladder for storing pressurized water and an on-board, manually operated, fluid transfer pump for transferring fluid from an unpressurized water chamber having a fill cap to the bladder. An example of the latter arrangement is disclosed in U.S. Pat. No. 5,875,927 entitled TOY GUN HAVING AN EXPANDABLE TEAR DROP SHAPED BLADDER FOR EJECTION OF LIQUID THEREFROM. It suffices to say that the manner in which water ejection forces are developed is of no particular consequence to the inventor herein except insofar as manufacturing cost, simplicity and ease of use are always considerations to be borne in mind.

Figure 2:
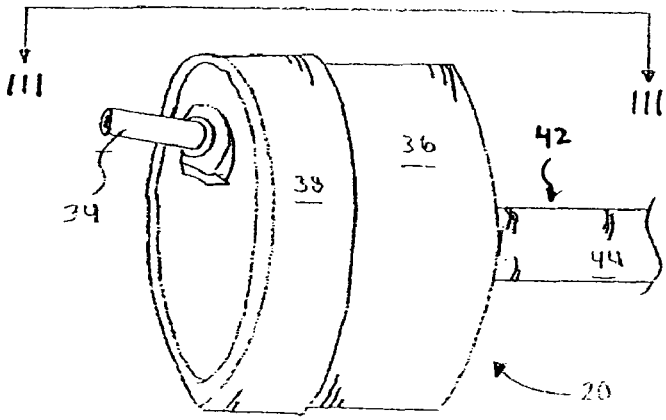
FIG. 2 is a perspective view depicting final assembly of the exemplary rotating nozzle translation assembly of FIG. 1.
Figure 3:
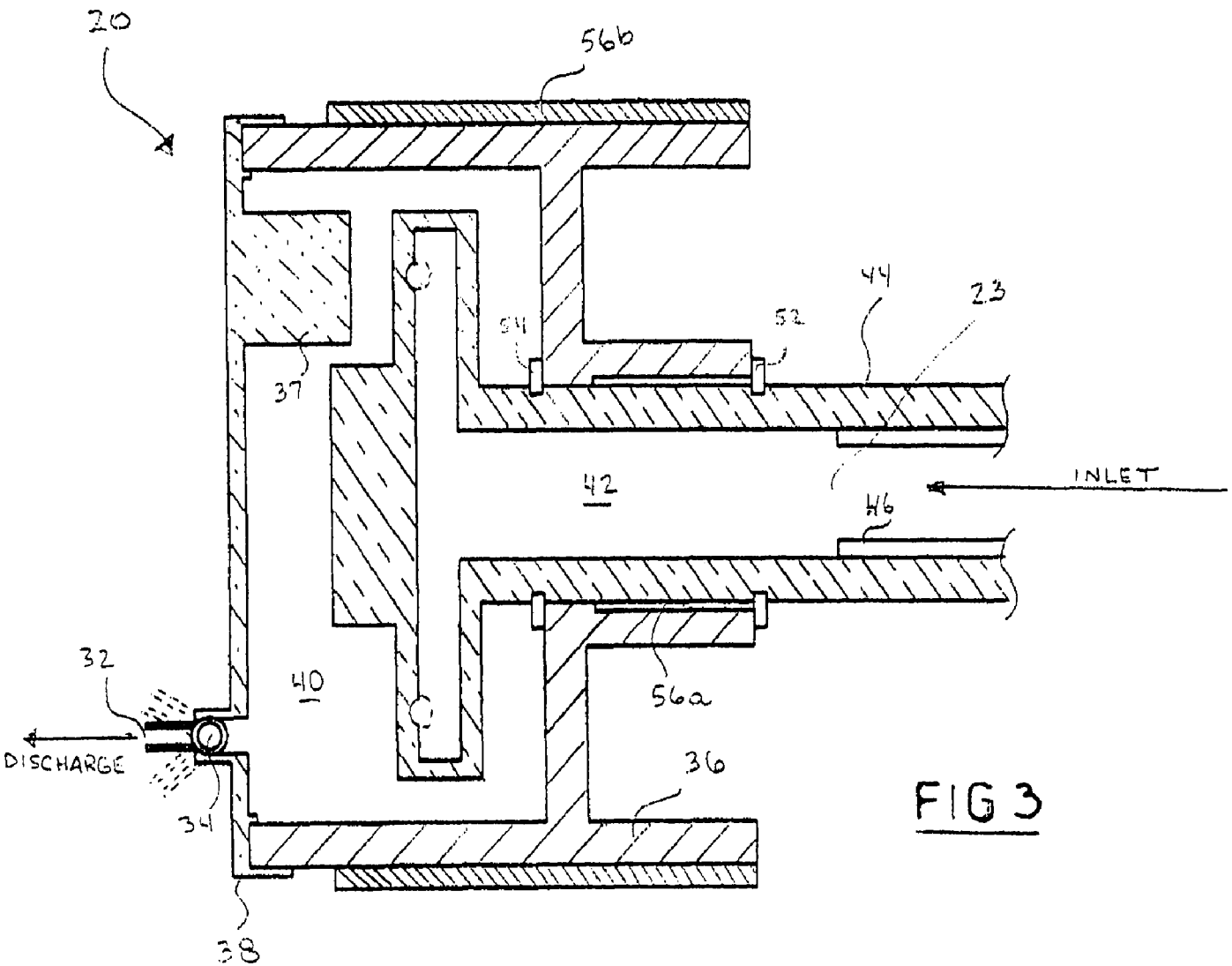
FIG. 3 is a cross sectional view of the exemplary rotating nozzle translation assembly of FIGS. 1 and 2, taken across the plane IV-IV depicted in FIG. 3.

Turning now to FIGS. 1-3, in which like elements are denoted by like reference numerals, a first illustrative embodiment of a nozzle translation assembly 20 in accordance with the present invention is depicted. The nozzle translation assembly 20 is dimensioned and arranged to rotate so that a stream of water being discharged through discharge orifice 32 defined by the element indicated generally at element 34, traverses a circular path relative to the longitudinal axis of rotation, while the housing structure itself remains stationary. The stream thus discharged has a helical or spiral configuration, which is unbroken for so long as the trigger is depressed and water is flowing through an inlet conduit.

Automatic rotation of nozzle translation assembly 20 to produce a helical or spiral discharge effect can be achieved in a variety of ways. By way of illustrative example, an illustrative nozzle translation assembly constructed in accordance with this embodiment of the invention may include a motorized drive assembly (not shown) responsive to depression of the trigger or, alternatively, to actuation of an on/off selector switch, and drivingly engageable with appropriate gearing coupled to nozzle translation assembly 20. By way of alternate example, discharge orifice 32 of nozzle translation assembly 20 may be dimensioned and arranged to impart a nozzle reaction force—that is offset relative to the axis of nozzle translation assembly rotation—as the stream of water is discharged. Even a relatively small angle of inclination of the discharge stream relative to a plane orthogonal to the rotational axis of the nozzle translation assembly is sufficient to induce rotation of the nozzle translation assembly. It should also be noted that triggerless structures are also contemplated by the inventor herein. For example, in a water gun employing a manually rotated crank to operate a liquid transfer pump, the rotating crank shaft can also be used to drive appropriate gearing for rotating nozzle translation assembly 20 at the same time. Other forms of triggerless operation contemplated include a voice actuation circuit responsive to speech signals, input by microphone, to operate a solenoid valve or other suitable structure disposed along the fluid communication path defined by a conduit.

In accordance with an especially preferred embodiment of the present invention, however, the force for spinning nozzle translation assembly 20 is provided via the pressurized water stream entering an inlet of the nozzle translation assembly 20. An exemplary structure adapted to utilize this force is depicted in FIGS. 1-3 and will now be described in detail. As seen in FIG. 1, nozzle translation assembly 20 comprises a first section 36 and a second section 38 which, when assembled into the configuration shown in FIGS. 2 and 3, define an interior cavity 40 (FIG. 3) within which is disposed a flow diverter assembly indicated generally at 42.

With reference to both FIGS. 1 and 3, it will be seen that flow diverter assembly 42 has a proximal end 44 dimensioned and arranged to receive and retain the distal end 46 of a conduit. The conduit and flow diverter assembly 42 are fastened together in a conventional manner such, for example, as by a suitable adhesive. As such, fluid diverter assembly 42 is not a moving part but, rather, is stationary despite being disposed within interior cavity 40. Fluid exiting the discharge orifice 23 of conduit enters an inlet 48 defined at the proximal end 44 of flow diverter assembly 42. The center of first section 36 defines an axial opening through which proximal end 44 is inserted. Locking rings indicated generally at 52 and 54 in FIG. 3 prevent axial movement of diverter assembly 42 relative to first section 38. A first bushing indicated generally at **56*a* enables first section to rotate about an axis defined by flow diverter assembly 42. To prevent water from leaking out of interior cavity 40, O-rings or other suitable gaskets may be utilized at the interface between the interior surface of bore 36*a* of first section 36 and the exterior surface of diverter assembly 42. A second bushing, indicated generally at 56*b* is provided to retain and support nozzle translation assembly 20 within body 12 of water gun 10** while still allowing it to freely rotate.

Defined within the interior axial surface 37 of second section 38 are a plurality of vanes 39. As best seen in FIG. 1, liquid entering inlet opening 48 of flow diverter assembly 42 exits via a pair of exit openings indicated generally at 60 and 62. As will be readily appreciated by those skilled in the art, exit opening 60 and 62 are dimensioned and arranged so as to cause corresponding jets of liquid to impinge upon the surfaces of vanes 39, thereby initiating rotation of first section 36 and second section 38.

In the illustrative embodiment depicted in FIGS. 1-3, it will be seen that water exits the spinning nozzle translation assembly 20 via a pivotably movable nozzle member 34. Such a structure is advantageous in that it gives the user a high degree of flexibility in defining the diameter and/or pitch of the helical stream which is discharged. Of course, if such flexibility is not a design constraint, then it is of course possible to integrally form a nozzle member directly as part of second section 38. In that regard, it is contemplated that a nozzle member so constructed may be configured to extend forward at any desired angle relative to the axis of rotation of rotatable nozzle translation assembly 20. It is further contemplated that multiple nozzle members may be included so as to cause to simultaneous streams to be helically wound about the axis of nozzle translation assembly rotation.

As an alternative embodiment, the nozzle translation assembly 20 of FIGS. 1-3 may be made without the vanes 39. The water exiting through the discharge orifice 32 exerts a thrust on the nozzle member 34 similar to the thrust exerted on a garden hose when water flows through the nozzle. If the discharge canal is arranged at a circumferential angle relative to a plane orthogonal to the axis of rotation, this thrust causes the first section 36 and second section 38 of the nozzle translation assembly 20 to rotate. According to this alternative embodiment, the rotation of the first and second sections 36, 38 is caused solely by the thrust created at the discharge orifice 32 of the nozzle member 34.

Figure 4A:
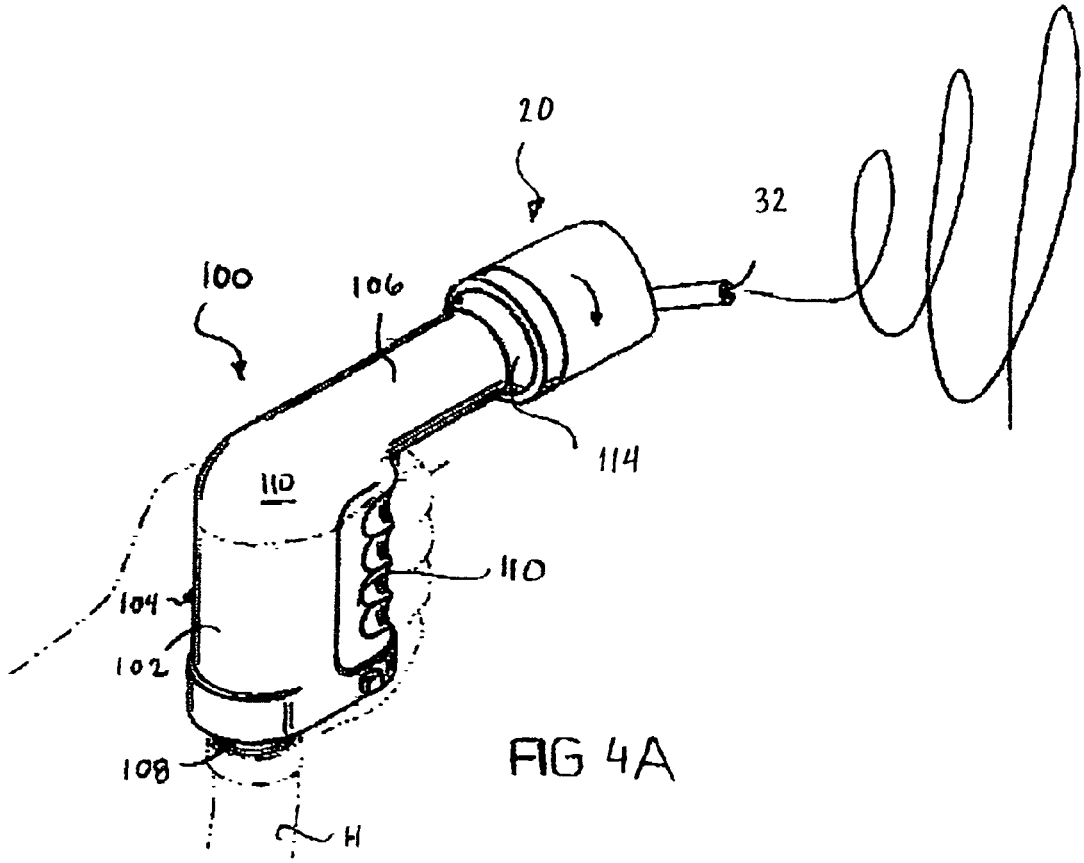
FIGS. 4A and 4B are perspective views showing the nozzle translation assembly of FIGS. 1-3 arranged on a garden hose nozzle.
Figure 4B:
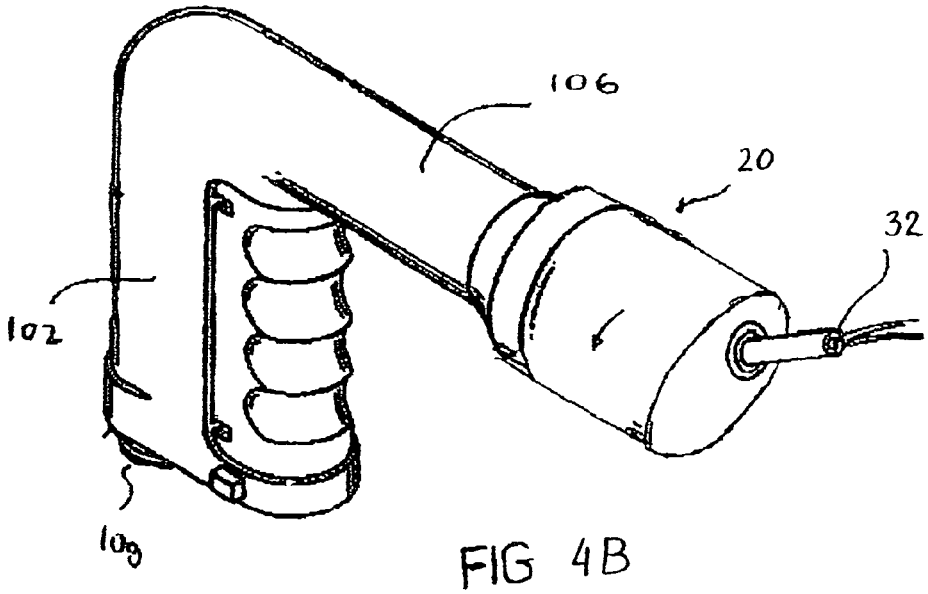

Turning now to FIGS. 4A-4B, there is shown a hand-held, hose-end nozzle device 100 constructed in accordance with a second illustrative embodiment of the invention. With initial reference to FIGS. 4A and 4B, it will be seen that device 100 comprises a conventional hose end adaptor assembly indicated generally at 108 having a body or housing 102 that includes a handle section 104 and a barrel portion 106. The conventional hose adaptor assembly 108 employed in the illustrative embodiment of FIGS. 4A and 4B is substantially as shown and described in U.S. Pat. No. 5,303,868, issued to Kroll on Apr. 19, 1994 and entitled Hose Nozzle, the disclosure of which is expressly incorporated herein by reference. It should, however, be emphasized that any conventional hose adaptor assembly operative to receive water via a source of municipally pressurized water by way of a hose attachment will suit the purposes of the present invention. Indeed, many conventional hose end nozzle assemblies incorporate not only a threaded inlet or proximal end, but also a threaded discharge or distal end. The latter configurations are especially suited for kit forms of the invention, in which a rotatable nozzle assembly is realized as an adaptor dimensioned and arranged for threaded engagement onto the distal end of a conventional hose end nozzle, rather than as an integrated assembly. In any event, and with continued reference to FIGS. 4A and 4B, water is introduced via an inlet opening 108 dimensioned and arranged for threaded engagement with the end of a conventional garden hose H. Depression of a conventional spring biased trigger, as trigger 110, opens a conventional, normally closed valve (not shown), thereby allowing water through an internal conduit that passes through the handle toward a distal end 114 of barrel portion 106.

As in the case of the embodiment of FIGS. 1-3, the embodiment of FIGS. 4A and 4B employs a rotating nozzle 20. While trigger 110 is in the "on" or an "intermediate" depressed position, nozzle assembly 20 rotates and water being discharged through a discharge outlet 32 thereof assumes a spiral trajectory in any direction the user chooses to aim barrel portion 106. Automatic rotation of nozzle assembly 20 to produce a spiral discharge effect can be achieved in a variety of ways. By way example, discharge outlet 32 of nozzle assembly 20 may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the nozzle assembly.

While the exemplary embodiment is shown as being connected to a garden hose attachment, the nozzle assembly 20 may be arranged on a wide variety of products such as a water gun, food dispensing container, sprinkler, water fountain nozzle, or any other device which receives a pressurized flowable liquid.

Figure 5A:
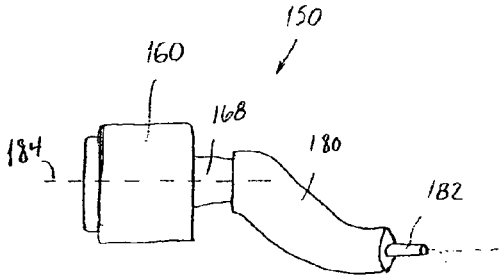
FIGS. 5A-C are side, front and longitudinal sectional views of a further embodiment of a nozzle translation assembly according to an embodiment of the present invention.
Figure 5B:
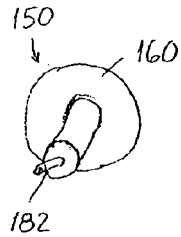
Figure 5C:
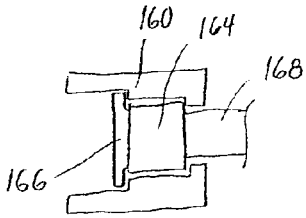
Figure 5D:
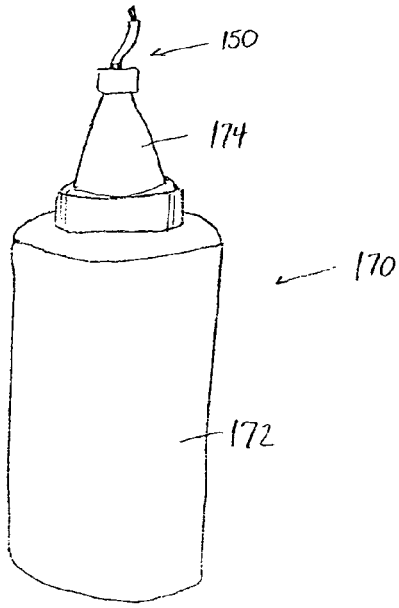
FIGS. 5D-E are perspective views of devices including the nozzle translation assembly of FIGS. 5A-C.

FIGS. 5A-5C disclose a further embodiment of a nozzle translation assembly 150 having a connector housing 160 connectable to a source of pressurized flowable liquid. This nozzle translation assembly 150 may be mounted on a water gun or hose nozzle as described above. Alternatively, the nozzle translation assembly 150 may be mounted on a container 170 as shown in FIG. 5D. The container has a cylindrical portion 172 holding the liquid to be dispensed. A top 174 is connected to the upper end of the container to which the nozzle translation assembly 150 is connected. The connection of the nozzle translation assembly 150 may be a friction fit, a threaded connection, or a snap-fit connection between the connector housing 160 and the top 174. Examples of the flowable liquid which may be in the container 170 include spin-art paint solution, a condiment such as ketchup, mustard, mayonnaise, relish, or any other liquid or granular material that is pourable into the neck of a container.

Container 170 may comprise a transparent or translucent plastic such as polypropylene or polyethylene to enable the user to gauge the amount and type of material in the container to determine when the container 170 is to be refilled (or discarded, as the case may be). Alternatively, the plastic may be color coded to identify the type of material. The plastic is also preferably resilient so as to enable the user to squeeze the container 170 and thus provide an internal pressure suitable to force a directed stream of material out of the container and towards a desired target. As noted previously, it should be understood that other means for urging the material toward a discharge opening may be employed.

Furthermore, the container 170 may comprise the shape of an action figure, cartoon character or any other figure or character, wherein squeezing the character-shaped container causes a patterned stream of water or other fluid to project from the nozzle.

As shown in FIGS. 5A-5C, a bearing 164 is mounted inside the housing 160 and includes a bearing input part 166 fixed with respect to the housing 160 and bearing output part 168 rotatable relative to the housing 160 via the bearing 164 about an axis of rotation 184. In some cases, the bearing input part 166 will not be required and the bearing can be mounted directly in the housing 160. The bearing 164 preferably comprises a sealed ball bearing assembly. However, any radial bearing which is sealed from or not affected by the flowing fluid may also be used. A discharge tube 180 having a discharge orifice 182 is connected to the bearing output part 168. Accordingly, the discharge tube 180 and discharge orifice 182 rotate about the axis of rotation 184. The discharge orifice 182 is radially offset from the axis of rotation 184 and is also angled so that a nozzle reaction force (thrust) which is created by a stream of fluid discharged from the discharge orifice 182 spins or rotates the discharge tube 180 about the axis of rotation 184, thereby creating a helical output stream. The angle of the discharge orifice 182 also determines how far the stream of water spreads radially. If the water spreads too far, the water stream breaks up and does not provide a helical-shaped stream. Accordingly, both the radial angle relative to the axis of rotation and the circumferential angle relative to a plane orthogonal to the axis of rotation determine the helical shape. A further factor which affects the nozzle reaction force (thrust) and the path of the stream is the diameter of the discharge orifice. When water is used, the discharge orifice of 0.05 to 0.10 inches is used. Wider orifices may be necessary for thicker substances such as, for example, ketchup or mustard.

Figure 5E:
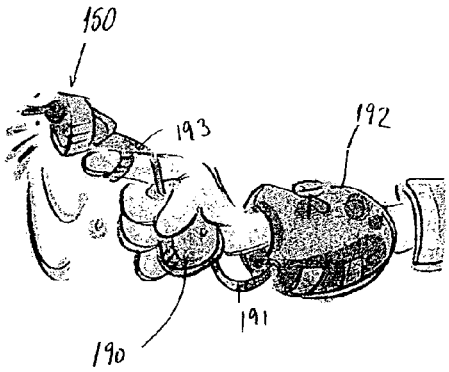

Instead of container 170, FIG. 5E shows an alternative embodiment in which a bladder 192 arranged to be worn on the arm of a user is connected by a conduit or tube 191 to a hand pump 190. An output of the hand pump is connected by a conduit or tube 193 to nozzle translation assembly 150. The hand pump 190 include valves (not shown) which direct fluid to the nozzle translation assembly when the hand pump is squeezed and which open a path between the hand pump and the bladder when pressure is released from the hand pump so that the hand pump draws fluid from the bladder as the hand pump expands back into its initial state after being squeezed. Accordingly, the nozzle translation assembly can be connected to a source of pressurized fluid (i.e., hand pump 190) by tube 193 or other conduit.

The hand pump 190 may alternatively comprise a character-shaped container held by a child user which is squeezed to emit a stream in a pattern as described above.

Figure 6:
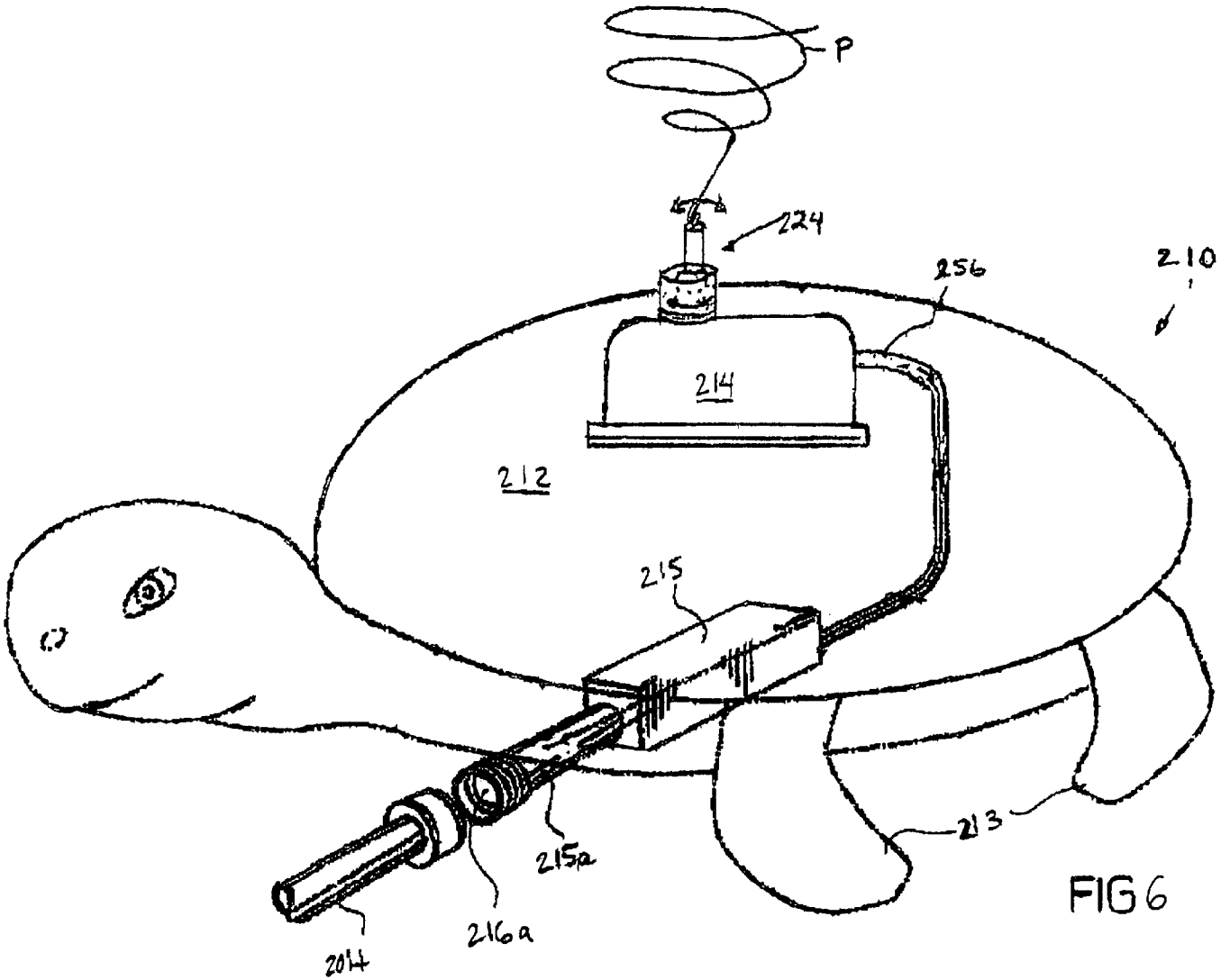
FIG. 6 is a side elevation view depicting a water discharging amusement device constructed in accordance with an illustrative water sprinkler embodiment of the present invention, the device being equipped with a nozzle assembly adapted to rotate automatically, as water is discharged, to produce an upwardly directed helix of water.
Figure 7:
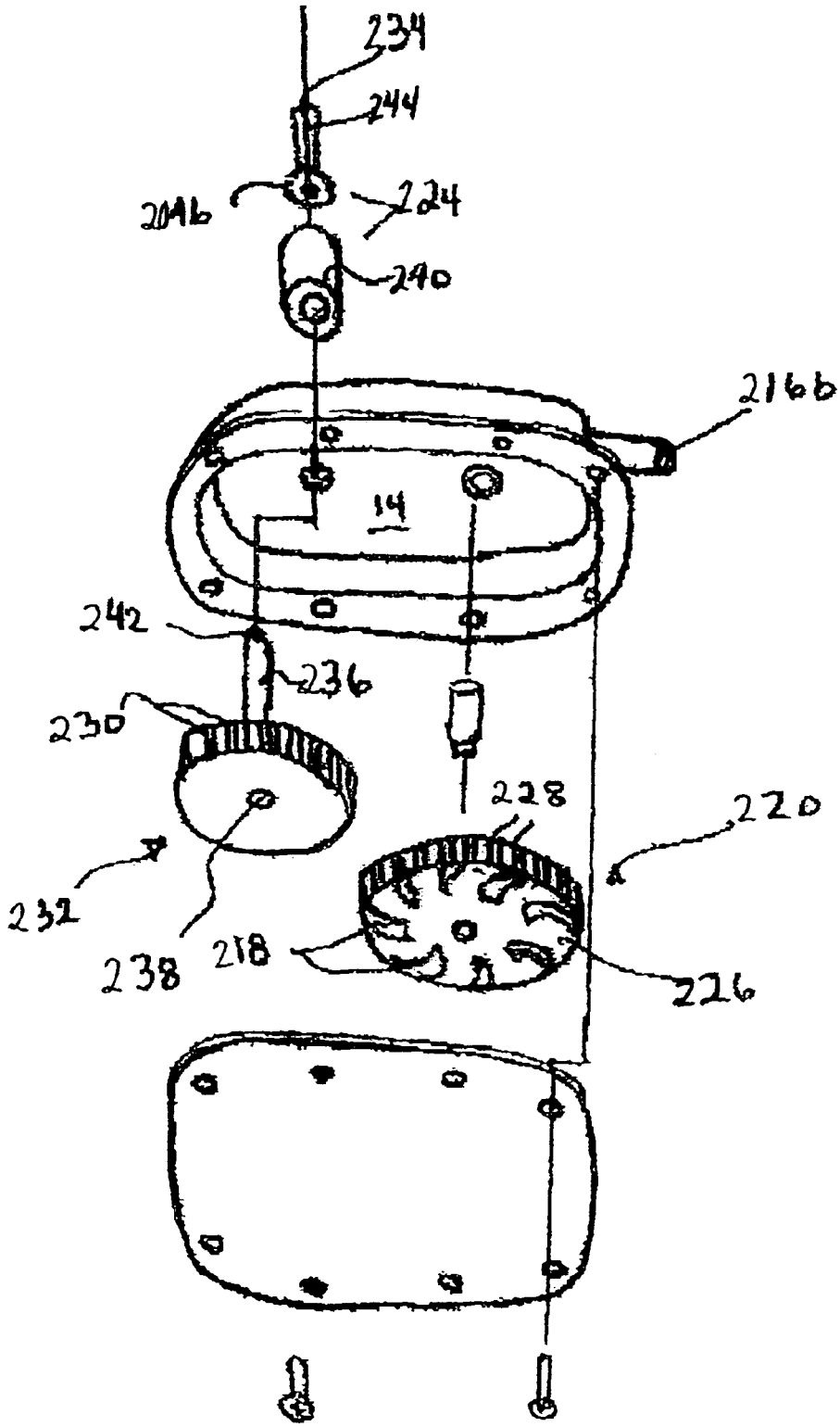
FIG. 7 is an exploded view depicting the internal construction of the exemplary embodiment of FIG. 6.

FIGS. 6 and 7 show another embodiment of a nozzle assembly 224 arranged on an elongated housing or body 212 having defined therein an interior chamber indicated generally at 214. In the illustrative embodiment, housing 212 has an animal shape having a plurality of downwardly depending legs 213 dimensioned and arranged for stable placement of housing 212 on a lawn or other suitable surface (not shown). Instead of being arranged on an animal shaped housing 212, the chamber 214 may be arranged on any structure such as a lawn sprinkler or may be arranged by itself. An inlet conduit 215 has a first end 215*a* dimensioned and arranged for threaded engagement with the end of a garden hose H and a second end 215*b* which enters chamber 214. A bore extending through conduit 215 has a first portion 216*a* having a first interior diameter conforming, more or less, to the diameter of the interior bore of the garden hose. In the exemplary embodiment of FIGS. 6 and 7, the bore has a second portion 216*b*

(FIG. 7) having a second diameter which is selected so as to function as a capillary tube. Illustratively, portion 216*b* may be on the order of about 0.062 inches in diameter. This arrangement has been found to limit the rate of water flow, over an expected range of municipal water pressures, to a level that preserves the spiral appearance of the discharge pattern. In that regard, it should also be noted that the inventor herein has observed that an advantageous arrangement is achieved when the diameter of portion 216*b* is less than the diameter of the orifice through which water is ejected by the device. When using a capillary tube section diameter of 0.062 inches, for example, advantageous results have been achieved with a nozzle orifice diameter of 0.074 inches.

As best seen in FIG. 7, it will be seen that water entering chamber 214 via capillary tube section 216*b* impinges upon the vanes 218 of turbine 220. Essentially, the purpose of turbine 220 is to convert the linear forces imparted by water entering via capillary tube section 216*b* into rotary forces suitable for rotating the rotatable nozzle assembly 224. To that end, the peripheral surface of a disk section 226 of turbine 220 defines a series of teeth 228 adapted to engage with corresponding teeth 230 on the peripheral surface of a driven gear assembly 232 that is secured to rotatable nozzle assembly 224. Accordingly, as turbine 220 rotates, driven gear assembly 232 and nozzle assembly 224 also rotate. To allow water to flow from within chamber 214 to the discharge opening 234 of nozzle assembly 224, driven gear assembly includes a shaft 236 that defines an axial discharge conduit 238. This arrangement permits water to pass from chamber 214 directly to the nozzle assembly 224.

With continuing reference to FIG. 7, it will be seen that nozzle assembly 224 comprises a cap member 240 which is secured to the distal end 242 of shaft 236. Within cap member 240 is a discharge tube 244 having a spherical inlet end 246 which is pivotably received within cap member 240 and adapted for pivotable movement therewithin. Such an arrangement permits the divergence of the spiral water stream P (FIG. 6) ejected by nozzle assembly 224 to be quickly and easily adjusted by the user. Specifically, pivoting nozzle end 234 of discharge tube 244 outwardly (i.e., so as to diverge away from the axis of rotation of assembly 224) produces a "tornado" effect in which the layers of water in path P expand outwardly as they rise vertically. The greater the angle of divergence, relative to a vertical axis of rotation, the wider the diameter achieved by each layer of water in the spiral path P. Even greater divergence may be achieved by offsetting the discharge path relative to the axis of rotation. It should be noted that although only one nozzle assembly is depicted in FIGS. 6 and 7, it will be readily appreciated by those skilled in the art that additional nozzle assemblies, as nozzle assembly 224, may be readily incorporated into the device 210.

Figure 8A:
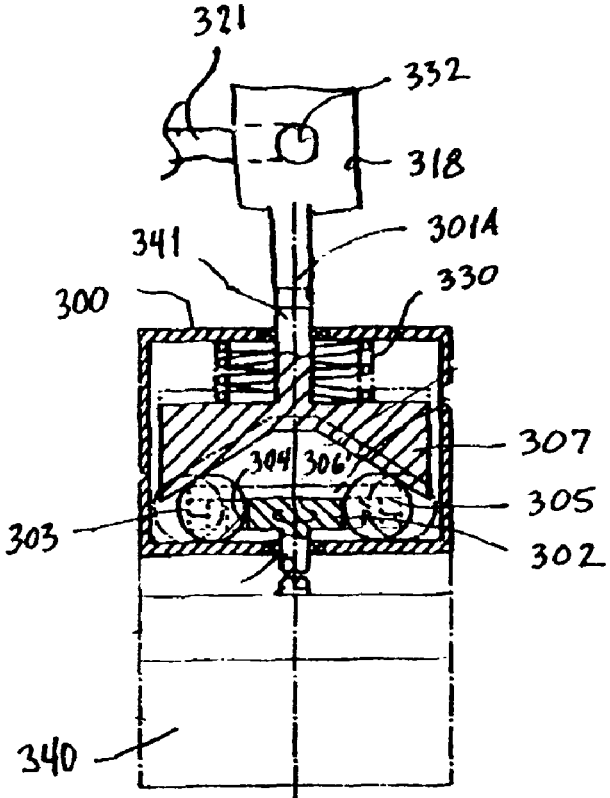
FIGS. 8A and 8B are cross sectional views depicting the internal construction of a nozzle translation assembly adapted to move the discharge orifice along a predefined, non-circular path in accordance with a modified embodiment of the present invention.
Figure 8B:
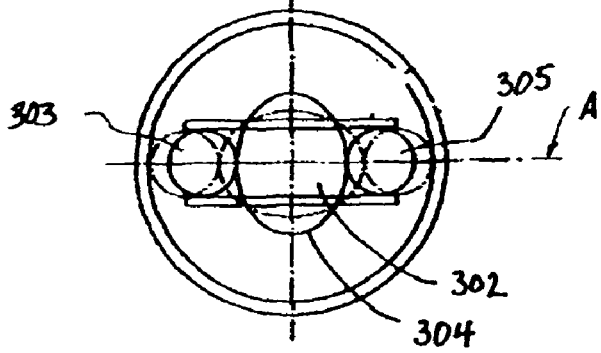

FIGS. 8A-8B depicts an alternate embodiment of the present invention in which non-circular movements of the nozzle discharge orifice, relative to the water gun housing, are achieved. Whereas the embodiment of FIGS. 1-7 may be characterized as approximating a "cyclone" or "twister" discharge configuration, the embodiment of FIGS. 8A and 8B is intended to achieve a "zig-zag" configuration. To that end, the nozzle translation assembly utilized in the illustrative embodiment of FIGS. 8A and 8B utilizes a mechanism 300 that includes a first cam 302 having an elliptical profile (FIG. 8B) and a peripheral cam face 304. As first cam 302 rotates, a pair of spherical members 303, 305 in contact with cam face 304 move in the radial direction. A conical cam face 306 of a second cam 307 is pressed against each spherical member 303, 305 by a pre-load spring 330. As such, the second cam 307 performs reciprocating linear movement in the direction of a central axis of rotation 301A when each spherical member 303, 305 moves in the radial direction. Thus, rotary movement of a rotary input shaft 311 connected to first cam 302 is converted into linear reciprocating movement of an output rod or extension 341 connected with second cam 307. A mounting member 318 on extension 341 receives the terminal end of a fluid conduit 321 that receives water under pressure from the water gun reservoir, the fluid conduit terminating at discharge orifice 332.

A drive 340 rotates the rotary input shaft. As will be readily appreciated by those skilled in the art, the drive 340 of FIGS. 8A and 8B may include a conventional electrical motor (not shown) or a conventional water turbine (such as the turbine shown in FIG. 7). In the latter case, water exiting the water turbine chamber is supplied by conduit 321 to discharge orifice 332. In any event, it will be readily ascertained by those skilled in the art that as mounting member 318 moves back and forth, so does discharge orifice 332. The result is a stream of liquid that moves side to side (or up and down, as the case may be) while the trigger mechanism is actuated, all without the need for the user to move the discharge housing.

Figure 9:
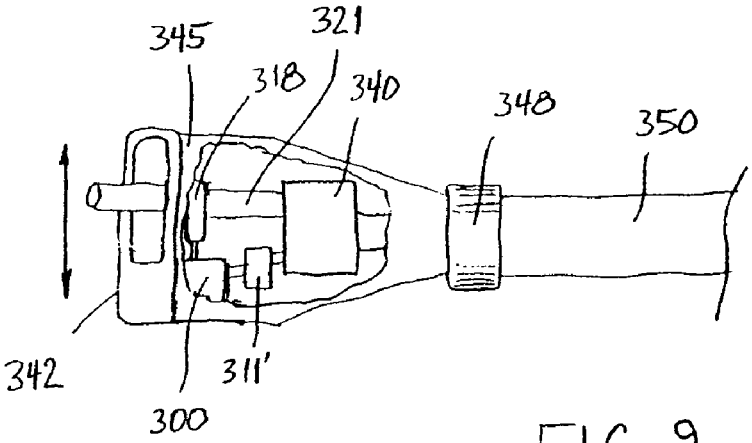
FIG. 9 is a nozzle connected to a hose and including the nozzle translation assembly of FIGS. 8A and 8B.

FIG. 9 is a specific implementation of the zig-zag configuration of FIGS. 8*a* and 8*b* in which the device of FIGS. 8*a* and 8*b* is incorporated into a housing 345 that includes a connection 348 for a garden hose 350, or other water carrying conduit. Water received from the garden hose is directed to the turbine drive 340 and is output from the turbine drive 340 to a conduit 321 which extends through a mounting member 318 connected to a mechanism 300 and through an elongate opening 342 in the housing 345. The turbine drive 340 is rotatably connected to the mechanism 300. Instead of being connected directly by a rotary input shaft 311 as in FIGS. 8A and 8B, the turbine drive 340 may be connected by a gear drive 311'. The mechanism 300 is arranged in the housing 345 so that the mounting member 318 is moved reciprocally and moves the open end of the conduit 321 along the length of the elongate opening. Water is thus ejected from the conduit 321 in a zig-zag pattern which simulates the back and forth motion which users typically apply to a hose nozzle when the users are, for example, cleaning a driveway surface. Thus, the housing 345 shown in FIG. 9 may, for example, be mounted on a broom so that a zig-zag pattern of water is projected in front of the broom. Although the housing 345 is shown as being connected to a conventional water supply by a hose, this nozzle can be connected to any pressurized water supply such as, for example, a pressure washer. Furthermore, the housing 345 may also be configured as the device 100 of FIGS. 4A-4B including the trigger 110 for selectively supplying the flow of water.

Figure 10:
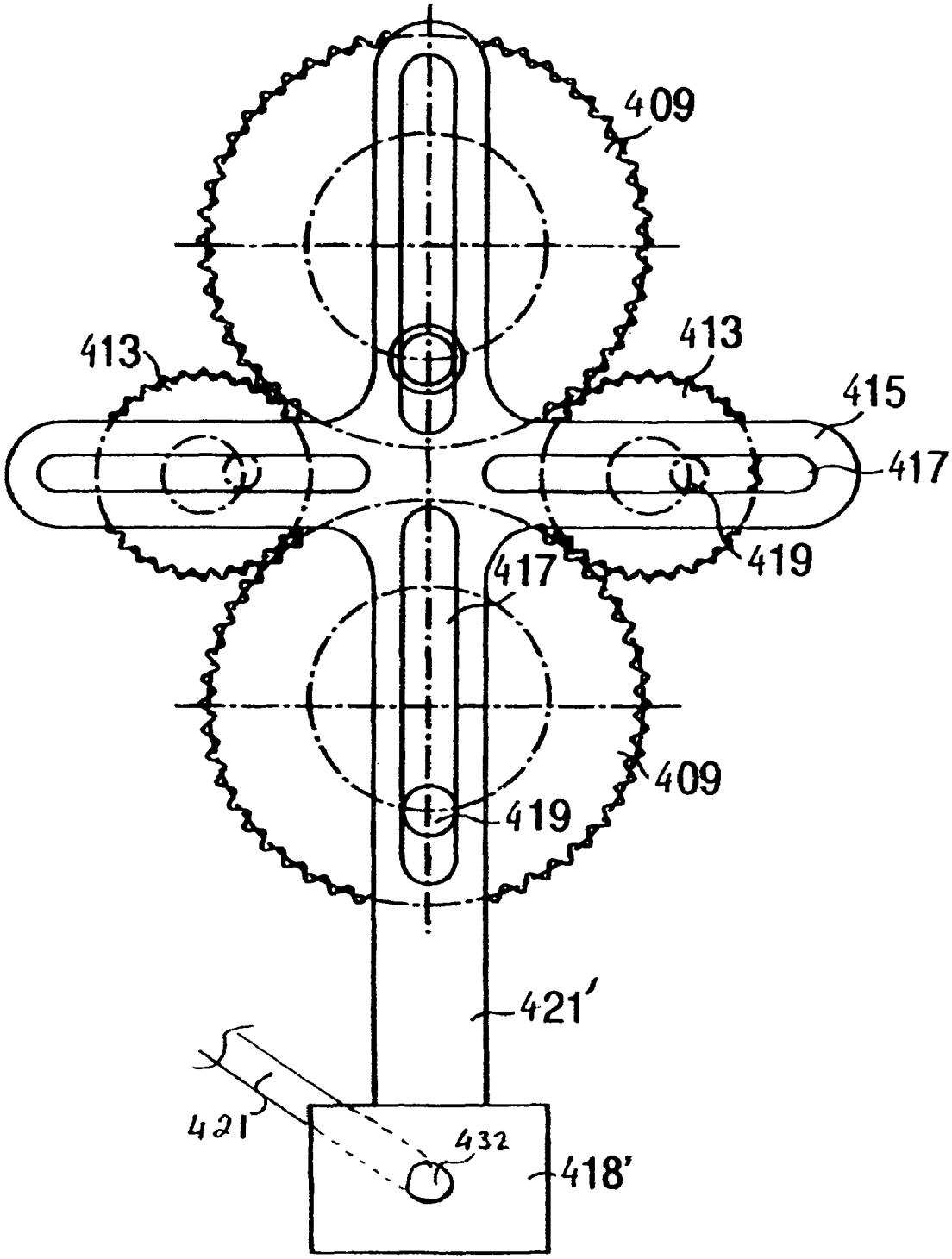
FIG. 10 is a plan view depicting the internal construction of a nozzle translation assembly adapted to move the discharge orifice along a predefined, non-circular path in accordance with yet another modified embodiment of the present invention.

FIG. 10 is intended to depict a nozzle translation assembly which achieves a "figure eight" flow pattern and, like the embodiment of FIGS. 8A and 8B, employs a mechanism for moving the discharge opening along the figure eight path. The mechanism depicted in FIG. 10 comprises a pair of larger gears 409, each of which is meshed alternatively with each of a pair of smaller gears 413 with a gear ratio of 2:1. A truss 415 is formed of four orthogonal arms, each arm having a slot 417 defined therein. A pin 419 off center in each gear slides in a corresponding slot so that an extension 421 of one arm moves in a figure eight when the gears are rotated. A mounting member 418 on the extension receives the terminal end of a fluid conduit 421 that receives water under pressure from the water gun reservoir, the fluid conduit terminating at discharge orifice 432. As will be readily appreciated by those skilled in the art, the gears of the rotary translation assembly of FIG. 10 may be driven by a conventional electrical motor (not shown) or by a conventional water turbine (such as the water turbine shown in FIG. 7). In the latter case, water exiting the water turbine chamber is supplied by conduit 421 to discharge orifice 432. The result is a stream of liquid that traverses a figure eight path for so long as the trigger mechanism is actuated, all without the need for the user to move the water gun housing.

If the smaller gears 413 are not meshed with the larger gears 409 and are rotated at the same speed, an oval pattern will be produced. Furthermore, the smaller gears 413 may be rotated much faster than the larger gears 409 to provide yet another unique pattern.

FIG. 11 discloses a further embodiment of a nozzle translation assembly including the drive 340 and a first mechanism 300 as described above with respect to FIGS. 8*a* and 8*b*. The drive 340 comprises a turbine drive and fluid conduit 521 exits the drive 340 and extends through first and second mounting members 518, 512. The first mounting member 518 is connected to the first mechanism 300 and is moved horizontally by the first mechanism 300. Accordingly, mechanism 300 controls the horizontal position of the fluid conduit 521. However, the first mounting member 518 also includes an elongate slot 514 which allows vertical movements of the fluid conduit 521. The second mechanism 500 is connected to the drive 340 by a gear train 511 which rotates a disk 520. A cam surface 522 is arranged on the disk 520 and is operatively connected to the second mounting member 512. As the disk 520 rotates, the cam surface 522 interacts with the second mounting member 512 to control the vertical position of the fluid conduit 521. The second mounting member 512 includes an elongate slot 516 which permits horizontal movement of the fluid conduit at all vertical positions. Accordingly, the first and second mounting members 518, 512 are used to move a discharge orifice 532 at the end of the fluid conduit 521 in horizontal and vertical directions, thereby moving the discharge orifice in a pattern. In an alternate embodiment, the drive 340 may comprise an electric motor FIGS. 12*a*, 12*b*, and 12*c* depict various shapes of the surface cam surface 522 of the disk 520 about the circumference of the disk. FIG. 12*a* shows the shape of the cam surface 522 associated with a circular pattern. This corresponds to the disk 520 shown in FIG. 11. In this case the high and low points of the cam surface 522 are associated with the top and bottom of the circle. Likewise the ends of the horizontal movements of the first mechanism are associated with the sides of the circle. FIG. 12*b* shows an embodiment in which the cam surface 522 is flat. This embodiment is associated with a zig-zag pattern because only the horizontal position of the discharge orifice 532 is changed. FIG. 12*c* shows an embodiment in which the cam surface comprises two undulations. This embodiment is associated with a Figure eight-shaped pattern.

Although only three specific shapes have been illustrated, those skilled in the art could devise many different shaped cam surfaces capable of causing the discharge orifice to traverse an infinite variety of paths such as, for example, cardioid, elliptical, ellipsoid, and ovoid. Likewise, the cam surface first cam 302 of mechanism 300 could also be altered.

Figure 15:
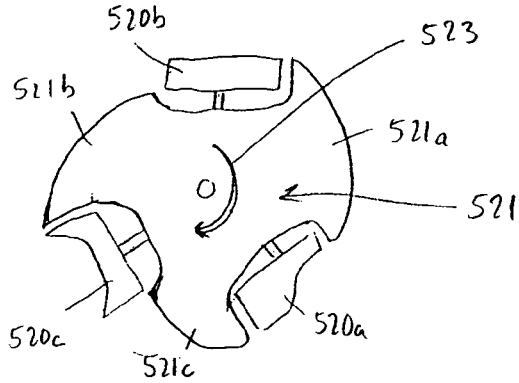
FIG. 15 is a front view of an element of the nozzle translation assembly of FIG. 13.
Figure 13:
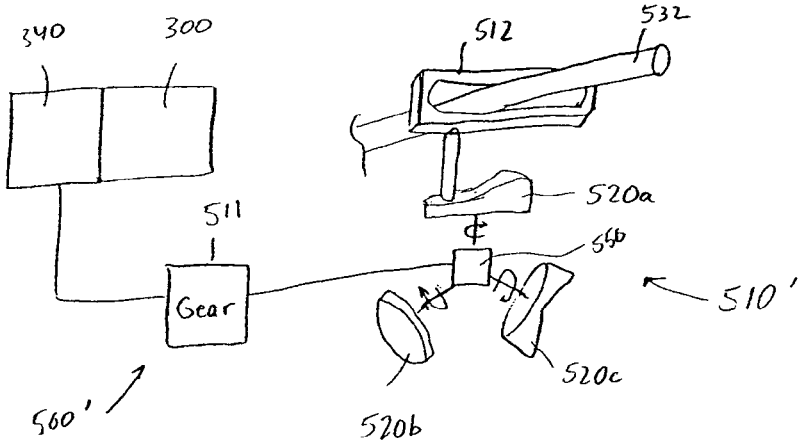
FIG. 13 is a schematic diagram of a further embodiment of the nozzle translation assembly of FIG. 11.
Figure 14:
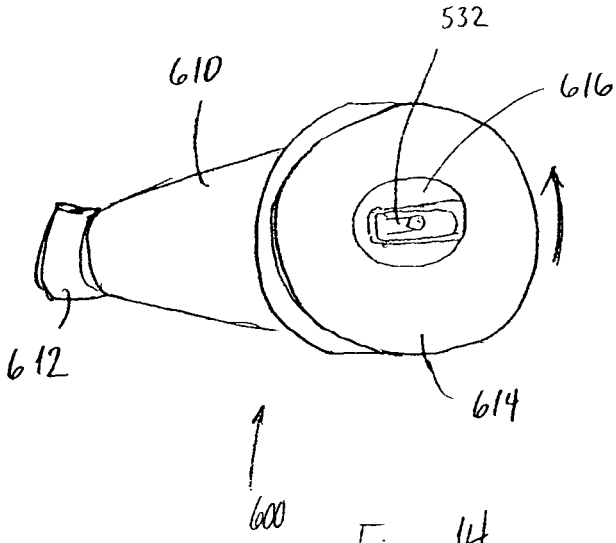
FIG. 14 is a perspective view of a nozzle housing in which the nozzle translation assembly of FIG. 13 is arranged.

As a further embodiment, the device of FIG. 13 includes a plurality of disks 520*a*, 520*b*, 520*c*, each connected to the gear train 511 connected to the drive 340. The first mechanism operates as discussed above with reference to FIG. 11. In this embodiment, one of the disks 520*a*, 520*b*, and 520*c* is selectively connected to the second mechanism 500. FIG. 14 shows a device which allows manual changing of the selected disk. A housing 610 includes a connection 612 for connecting to a pressurized water supply such as, for example, a garden hose. An aperture 616 in front of the housing 610 allows movement of the discharge orifice 532. A selector knob 614 is rotatably arranged on a front of the housing 610 and operatively connected to the array of disks 520*a*, 520*b*, and 520*c* for changing the disk that is selectively connected to the second mechanism 500. Each of the disks 520*a*, 520*b*, and 520*c* must be aligned in the proper positional relationship with the first mechanism 300 to achieve the desired pattern. In order to maintain this proper positional relationship with the first mechanism 300, each of the disks 520*a*, 520*b*, 520*c* is always connected to the gear train regardless of whether the disk is in the selected position. Furthermore, FIG. 15 shows that the assembly of disks 520*a*, 520*b*, and 520*c* may further includes bridges 521*a*, 521*b*, and 521*c* between adjacent ones of the disks to ensure smooth transition between two positions. In this embodiment, the bridges 521*a*, 521*b*, 521*c* are formed as the radially outer sides of an element 521 which supports the axes of each of the disks 520*a*, 520*b*, and 520*c*. In this case, the element rotates in the direction of arrow 523. Each of the bridges is arranged to start at the lowest level of a previous disk and end at the highest point on the next disk. This ensures that the portion of the mounting member 512 resting on the disks (see, e.g., FIG. 13) is smoothly transitioned from disk to disk.

Figure 16:
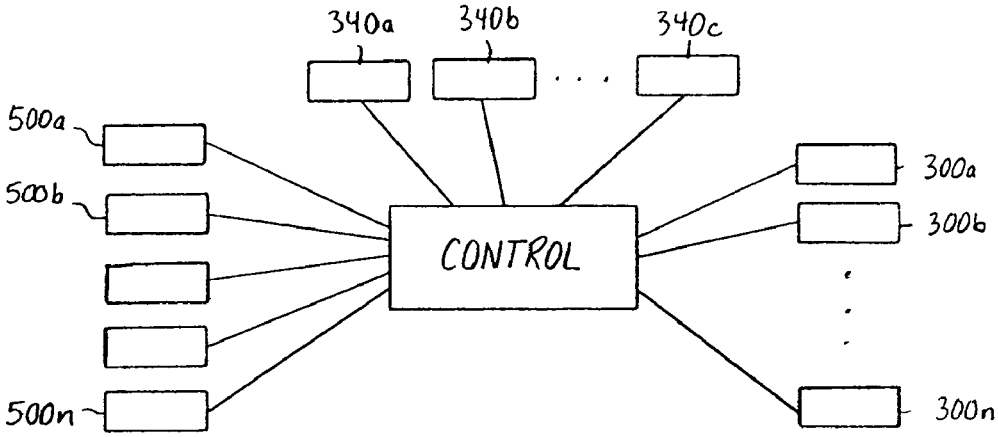
FIG. 16 is a schematic diagram of a control circuit for controlling a plurality of nozzle translation assemblies.
Figure 17:
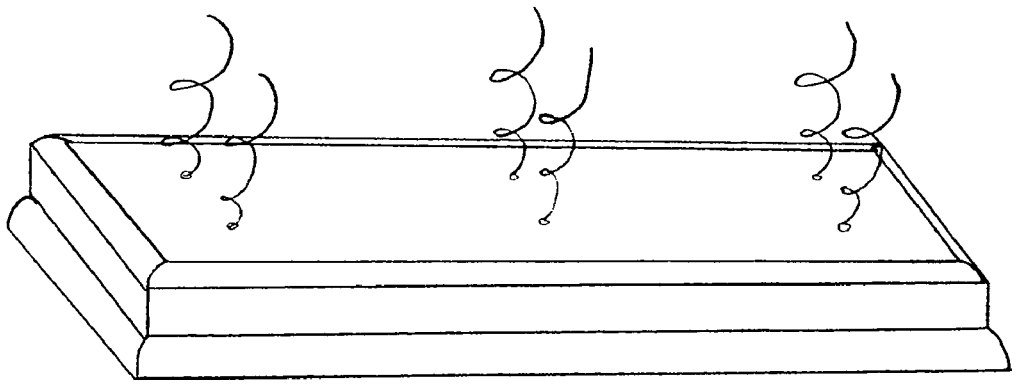
FIG. 17 is a perspective view of an arrangement of a plurality of nozzle translation assemblies arranged as individual water fountains.

Instead of a manual movement of the disks 520*a*, 520*b*, and 520*c*, the movement may be automatically implemented by gearing 550 which may, for example, operate similar to an odometer in that the disks 520*a*, 520*b*, and 520*c* are switched every n turns of the individual disks 520*a*, 520*b*, and 520*c*. Alternatively, an electric motor controlled by a control unit 700 may be used to select one of the disks 520*a*, 520*b*, and 520*c*. According to FIG. 16, a plurality of the nozzle translation assemblies 500' shown in FIG. 13 may be controlled by a control unit 700. This may be used for applications in which the assemblies 500' are used as individual fountains of a fountain display. FIG. 17 shows a pool 800 including six fountains 802. Each of the fountains includes the nozzle translation assembly 500' of FIG. 13. According to this embodiment, each of the fountains is individually controllable in three ways. The first mechanism 300 is controlled as either on or off, the second mechanism 500 is controlled by selecting which one of the disks to use and the drive is controlled for turning the individual fountain on or off.

Figure 19:
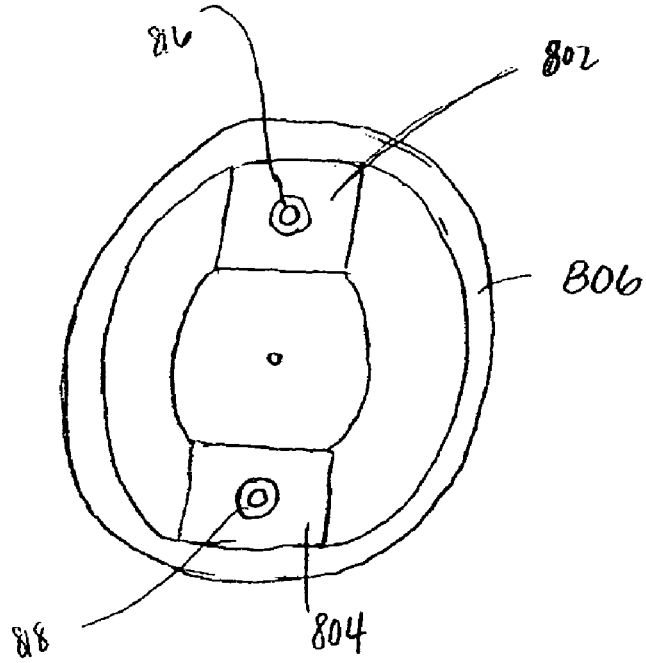
FIG. 19 is a rear view of the mechanism of FIG. 18.
Figure 18:
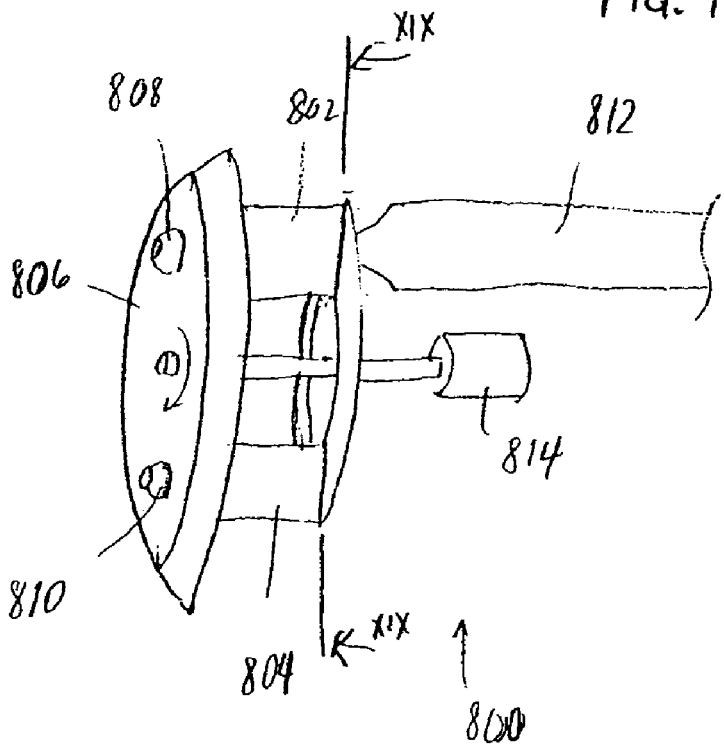
FIG. 18 is a perspective view of a mechanism comprising two separate nozzle translation assemblies.

FIGS. 18 and 19 shows another embodiment for switching between patterns. A device 800 includes two nozzle translation assemblies 802, 804. Each of these nozzle translation assemblies may comprise any one of the previously described nozzle translation assemblies. The nozzle translation assemblies 802 and 804 preferably have different patterns and are mounted on a rotatable wheel 806 having apertures 808 and 810 through which the streams ejected from the nozzle translation assemblies 802, 804 flow. A fluid supply conduit 812 is selectively connected to one of the nozzle translation assemblies depending on which of the assemblies is aligned with the supply conduit 812. Thus, rotating the wheel 806 changes the nozzle translation assembly that receives the flow of fluid. The connection between the conduit 812 and the nozzle translation assemblies 802, 804 my be accomplished using sealed connections 816, 818 (see FIG. 19). This is similar to the mechanism used in variable spray hose nozzles for switching between the various spray settings. The device 800 may mounted on a lawn sprinkler so that a user can switch between the various spray patterns of the different nozzle translation assemblies 802, 804.

A motor 814 may be arranged on the wheel 806 of device 800 so that the nozzle translation assemblies 802, 804 can be changed automatically. The motor 814 may be connected to a controller such as the controller 700 in FIG. 16. This embodiment of device 800 with the motor 814 may be arranged or mounted on a nozzle of a water fountain. The position of the device 800 may be changed automatically to provide a changing display. Furthermore, a plurality of such devices may be arranged and connected to a controller 700 for a coordinated changing display.

Figure 20:
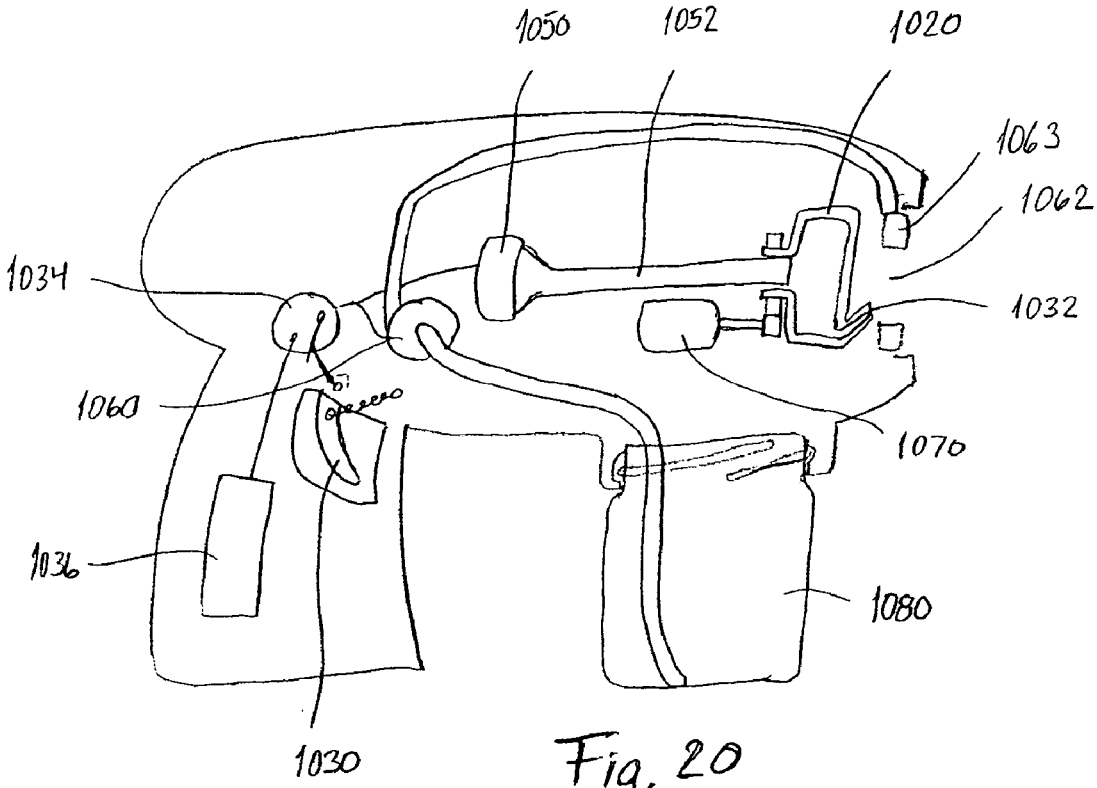
FIG. 20 is a schematic sectional view of a bubble-blowing device having a nozzle according to an embodiment of the present invention.
Figure 21:
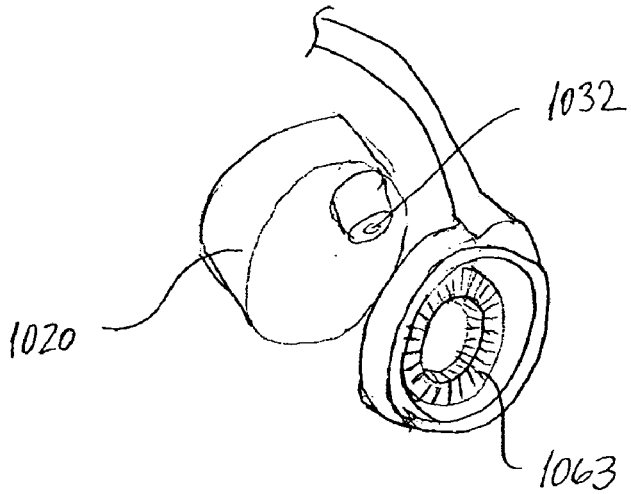
FIG. 21 is a perspective view of the nozzle of FIG. 20.

FIGS. 20 and 21 disclose a further embodiment in which air is the liquid directed through the nozzle. A bubble blowing device 1000 includes a fan 1050 which directs air drawn from the atmosphere or inside the device 1000 through a supply conduit 1052 to a nozzle translation assembly 1020 having a discharge orifice 1032. The air exits the nozzle translation assembly 1020 through the discharge orifice 1032 and is directed through an aperture 1062 defined by a ring 1063 that is supplied with a bubble solution as described in more detail below. Instead of using the fan 1050, the device may be connected to or contain a pressurized air supply.

In the specific embodiment of FIGS. 20 and 21, an electric motor 1070 is connected to the nozzle translation assembly 1020 via a gear train 1072 for rotating the nozzle translation assembly 1020 when the motor is activated. The discharge orifice 1032 is arranged on the nozzle translation assembly so that the air is directed through the ring 1063 at an angle relative to a line normal to a plane of the aperture. The ring 1063 may, for example, be designed as one of the ends of wands that are typically supplied with toy bubble-blowing solution bottles, or any other known or hereafter developed ring in which a film of bubble-solution is formed. As the nozzle translation assembly 1020 rotates, the direction of the air through the aperture 1062 changes in a circular pattern, thereby creating a spiral output of the airstream. Instead of the specific embodiment shown, the nozzle translation assembly 1020 may alternatively comprise any of the previously described spiral producing nozzle translation assemblies 20 (FIG. 1, FIGS. 4A-4B), 150 (FIGS. 5A-5C), 224 (FIGS. 6-7), which produce a spiral or circular discharge, or the other nozzle assemblies of FIGS. 8A, 8B, 9, 10, and 11. As in the previously described embodiments, the nozzle translation may move in response to the force produced by the flow of air or by other electrical or mechanical means.

A bubble solution reservoir 1080 is connected to the device 1000 which includes a pump 1060 that draws the fluid from the reservoir and delivers the fluid to an area above the ring 1063. As the solution falls, the bubble solution forms a film in the aperture 1062 through which the air stream is directed, so that bubbles are formed and exit the device 1000 in the direction of the airstream. Since the direction of the airstream changes due to the movement of the nozzle translation assembly, the bubbles are formed in a pattern such as, for example, a spiral. A drip tray 1082 may be formed below the aperture 1062 to direct excess fluid back to the bubble solution reservoir 1080. In the embodiment shown in FIGS. 20-21, the reservoir 1080 is a standard toy bubble solution container. The device 1000 is arranged so that it releasably receives the top of the standard toy bubble solution container. As an alternative, the reservoir may be designed integrally in the device so that it has to be filled by an access port.

A manually operated trigger 1030 arranged on the device 1000 is spring loaded in an off position. When the trigger is moved to an on position, an electrical switch 1034 connects a power supply 1036, i.e., battery, for supplying electric power to the pump 1060, the fan 1050, and the motor 1070. Accordingly, a spiral or other stream of bubbles is produced as described above when the trigger is activated. Instead of being connected to an electrical switch, the trigger may be connected by mechanical means, i.e., a gear train, to move the pump, the fan, and the nozzle rotation assembly.

In the embodiment of FIGS. 20 and 21, the ring 1063 forming the aperture 1062 is held stationary while the nozzle translation assembly 1020 rotates. However, it is also possible for the aperture 1062 which receives the bubble solution to move with the discharge orifice 1032. In this case, the bubble solution may be fed directly into the supply conduit 1052 so that both the air and the bubble solution are discharged through the discharge orifice 1032.

It should be emphasized that although specific illustrative paths—along which the discharge orifice may be configured to move—have been illustrated and described herein in detail in the foregoing description, it is deemed to be within the level of skill of the ordinary artisan to devise a variety of alternate nozzle translation mechanisms capable of causing the discharge orifice to traverse an array of such paths as, for example, cardoid, elliptical, ellipsoid, ovoid, etc. Thus, while the particular nozzle translation as herein shown and described in detail are fully capable of attaining the above-described objects of the invention, it is to be understood that they are merely illustrative embodiments of the present invention and are thus merely representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

It will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. For example, the nozzle translation assembly of FIG. 9 may use any mechanism that produces a reciprocating movement such as second mechanism 510 disclosed in FIG. 11. Furthermore, the nozzle translation assembly of FIG. 11 may use two first mechanisms 300 for both horizontal and vertical movement or two second mechanisms 510 instead of using the first mechanism 300 for horizontal and the second mechanism 510 for vertical movement. It is the intention, therefore, to be limited only as indicated by the scope of the claims appended hereto.

What is claimed is:

1. A device for delivering a stream of bubbles, comprising:

a housing;

an air supply conduit arranged in said housing for receiving pressurized air and having an output end;

a nozzle having a discharge orifice movable relative to said housing, said nozzle being directly connected to said output end of said air supply conduit for receiving said pressurized air and being rotatable about an axis of rotation;

a mechanism controlling a movement of said discharge orifice and powered by one of a flow of the pressurized air through said nozzle, an electrical device, or a mechanical device so that said discharge orifice moves relative to said housing in a defined pattern;

a stationary ring arranged downstream of said discharge orifice, said discharge orifice being directed at least partially radially inward toward said axis of rotation so that a stream of air discharged through said discharge orifice is directed toward said axis of rotation and through an aperture defined by said stationary ring; and a bubble solution supply device arranged in said housing and connectable to a reservoir for delivering bubble solution from the reservoir to said stationary ring such that a film of bubble solution forms in said aperture defined by said ring, wherein said stream of air directed through said aperture forms bubbles in said defined pattern.

2. The device of claim 1, wherein said nozzle is rotatable in response to a thrust caused by a flow of the air exiting said discharge orifice.

3. The device of claim 1, wherein said mechanism comprises an electric motor and said device comprises a gear train connected between said motor and said nozzle such that said nozzle rotates when said motor is activated.

4. The device of claim 3, further comprising a manually actuatable trigger for activating said motor and said bubble solution supply device.

5. The device of claim 3, further comprising a fan operable for generating pressurized air and delivering said pressurized air through said air supply conduit.

6. The device of claim 5, further comprising a manually actuatable trigger for simultaneously activating said motor, said fan, and said bubble solution supply device.

7. The device of claim 1, wherein said nozzle comprises a tube rotatably connected to said housing, said discharge orifice being connected to said tube so that the air flows through said tube and into said discharge orifice.

8. The device of claim 7, wherein said tube and said discharge orifice are rotatable in response to a thrust caused by a flow of the air exiting said discharge orifice.

9. The device of claim 1, wherein said mechanism comprises a cover rotatably connected to said housing and defining a cavity with said housing, said cover having vanes onto which a flow of the pressurized supply of air is directed so that said cover rotates in response to the flow of the pressurized supply of liquid, said discharge orifice being connected to said cover.

10. The device of claim 1, wherein said mechanism comprises a turbine wheel driven by a flow of the pressurized air, said discharge orifice being arranged on a part driven by said turbine wheel.

11. The device of claim 1, wherein said mechanism comprises a first mechanism arranged for moving said nozzle back and forth in a first direction.

12. The device of claim 11, wherein said mechanism further comprises a second mechanism for moving the nozzle back and forth in a second direction, said first and second mechanisms operating simultaneously for creating a helical stream.

13. The device of claim 11, further comprising a drive for driving said first mechanism.

14. The device of claim 13, wherein said drive comprises an electric motor.

15. The device of claim 13, wherein said drive comprises a turbine driven by a flow of the pressurized liquid.

16. The device of claim 1, wherein said air supply conduit further comprises a connection connectable to a pressurized air supply.

17. The device of claim 16, further comprising a manually actuatable trigger connected to a valve for selectively supplying pressurized air to said nozzle.

18. The device of claim 1, wherein said stationary ring is mounted on said housing so that said stationary ring is disposed at a fixed position relative to said housing.

* * * * *